US007239299B2

(12) United States Patent
Wu et al.

(10) Patent No.: US 7,239,299 B2
(45) Date of Patent: Jul. 3, 2007

(54) DRIVING CIRCUIT OF A LIQUID CRYSTAL DISPLAY DEVICE

(75) Inventors: Yuan-Liang Wu, Tainan Hsien (TW); Hsin-Ta Lee, Tainan Hsien (TW); Wen-Chieh Lin, Tainan Hsien (TW)

(73) Assignee: Chi Mei Optoelectronics Corporation, Tainan Hsien (TW)

( * ) Notice: Subject to any disclaimer, the term of this patent is extended or adjusted under 35 U.S.C. 154(b) by 551 days.

(21) Appl. No.: 10/605,760

(22) Filed: Oct. 24, 2003

(65) Prior Publication Data

US 2004/0189563 A1 Sep. 30, 2004

(30) Foreign Application Priority Data

Oct. 24, 2002 (TW) ..... 91124837 A

(51) Int. Cl.
*G09G 3/36* (2006.01)
*G09G 3/20* (2006.01)

(52) U.S. Cl. ..... 345/98; 349/33

(58) Field of Classification Search ..... 345/87, 345/206, 55, 98, 100, 99, 101; 349/56, 139, 349/33

See application file for complete search history.

(56) References Cited

U.S. PATENT DOCUMENTS

2003/0124828 A1* 7/2003 Lu et al. ..... 438/600

FOREIGN PATENT DOCUMENTS

JP 401319094 * 12/1989

* cited by examiner

*Primary Examiner*—Dennis-Doon Chow
(74) *Attorney, Agent, or Firm*—Winston Hsu

(57) ABSTRACT

A driving circuit of a liquid crystal display device includes a substrate, at least two driver integrated circuit (IC) chips located on the substrate, and an impedance device electrically connected between the two driver IC chips for reducing a difference between respective input voltages being input into the two driver IC chips.

17 Claims, 8 Drawing Sheets

DRIVING CIRCUIT OF A LIQUID CRYSTAL DISPLAY DEVICE

BACKGROUND OF INVENTION

1. Field of the Invention

The present invention relates to a driving circuit of a liquid crystal display (LCD) device, and more particularly, to a driving circuit capable of reducing a difference between respective input voltages being input into driver integrated circuit (IC) chips.

2. Description of the Prior Art

A thin film transistor display, such as a thin film transistor liquid crystal display (TFT-LCD), utilizes many thin film transistors, in conjunction with other elements such as capacitors and bonding pads, arranged in a matrix as switches for driving liquid crystal molecules to produce brilliant images. The advantages of the TFT-LCD over a conventional CRT monitor include better portability, lower power consumption, and lower radiation. Therefore, the TFT-LCD is widely used in various portable products, such as notebooks, personal data assistants (PDA), electronic toys, etc. Gradually, the TFT-LCD is even replacing the CRT monitor in desktop computers.

Generally speaking, a TFT-LCD includes an upper substrate having a plurality of color filters, a lower substrate, and a plurality of liquid crystal molecules filled between the upper substrate and the lower substrate. Additionally, a plurality of scanning lines and a plurality of signal lines perpendicular to the scanning lines are formed on the lower substrate. At least one thin film transistor, used as a switch device of a pixel, is formed at an intersection of each of the scanning lines and each of the signal lines.

Please refer to FIG. 1. FIG. 1 is a schematic diagram of a liquid crystal display panel. As shown in FIG. 1, a liquid crystal display panel 10 comprises a substrate 12 and an X-board 14. The X-board 14 is used for outputting signals into the substrate 12, for making the liquid crystal display panel 10 display an image. Moreover, the liquid crystal display panel 10 further comprises a plurality of tape carrier packages (TCP) 16 that are used for electrically connecting the X-board 14 and the substrate 12. Each of tape carrier packages 16 packages a driver integrated circuit (IC) chip (not shown) thereon.

The substrate 12 comprises a plurality of scanning lines $S_1$-$S_m$, and a plurality of signal lines $D_1$-$D_n$ perpendicular to the scanning lines $S_1$-$S_m$. A plurality of pixels (not shown) are therefore defined in an active region 18 by the scanning lines $S_1$-$S_m$ and the signal lines $D_1$-$D_n$. Additionally, the substrate 12 further comprises an outer lead bonding (OLB) region 20, and a driving circuit 22 positioned in the outer lead bonding region 20. The driving circuit 22 includes driver IC chips 22*a*, 22*b*, and 22*c* that are used for outputting switching or addressing signals into the scanning lines $S_1$-$S_m$. The above-mentioned driver IC chips packaged in the tape carrier packages 16 are used for outputting image signals into the signal lines $D_1$-$D_n$.

Moreover, the driver IC chips 22*a*, 22*b*, 22*c* are directly formed on the substrate 12 by use of the chip-on-glass (COG) technology. The driving circuit 22 further comprises a plurality of conductive wires 24 for electrically connecting the driver IC chips 22*a*, 22*b*, and 22*c*. For reducing a production cost, the conductive wires 24 are directly formed on the substrate 12, which is so-called wiring on array (WOA) technology. Thereafter, please refer to FIG. 2. FIG. 2 is an equivalent circuit of the driving circuit shown in FIG. 1. As shown in FIG. 2, an equivalent circuit 30 comprises the driver IC chips 22*a*, 22*b*, 22*c*, and resistors 32*a*, 32*b*. The resistor 32*a* connects the driver IC chips 22*a* and 22*b*, and corresponds to the conductive wires 24 located between the driver IC chips 22*a* and 22*b* as shown in FIG. 1. Similarly, the resistor 32*b* is connected between the driver IC chips 22*b* and 22*c*, and corresponds to the conductive wires 24 located between the driver IC chips 22*b* and 22*c* as shown in FIG. 1.

Referring to FIG. 1, when the liquid crystal display panel 10 displays an image, a voltage pulse of a controlling signal 28 is output from the X-board 14, and then, the voltage pulse is sequentially inputted into the driver IC chips 22*a*, 22*b*, 22*c* through the tape carrier packages 16 and the conductive wires 24. Finally, switching or addressing signals are outputted from the driver IC chips 22*a*, 22*b*, 22*c*, and are inputted to the scanning lines $S_1$-$S_m$. However, due to the extremely large electrical resistance of the conductive wires 24, a voltage drop on each of the conductive wires 24 is significant. Therefore, when the voltage pulse of the controlling signal 28 is sequentially transmitted to the driver IC chips 22*a*, 22*b* and 22*c*, the respective input voltages being input into the driver IC chips 22*a*, 22*b* and 22*c* are quite different. That is, the respective input voltages being input into the driver IC chips 22*a*, 22*b* and 22*c* vary with the positions of the driver IC chips 22*a*, 22*b* and 22*c*. In order to reduce the electrical resistance of the conductive wires 24, manufacturers currently usually increase a width or a thickness of the conductive wire 24.

Additionally, an insulation layer is formed between each of the scanning lines $S_1$-$S_m$ and each of the signal lines $D_1$-$D_n$, and further, the scanning lines $S_1$-$S_m$ and the signal lines $D_1$-$D_n$ are made of conductive materials. Accordingly, a parasitic capacitor is formed at an overlapping region 26 of each of the scanning lines $S_1$-$S_m$ and each of the signal lines $D_1$-$D_n$. As the voltage pulse input into each of the signal lines $D_1$-$D_n$ is changed, the voltage variations on the signal lines $D_1$-$D_n$ will be coupled to the scanning lines $S_1$-$S_m$ through the parasitic capacitors at the overlapping regions 26, thus producing a glitch to disturb the controlling signal 28. That is, due to the parasitic capacitors at the overlapping regions 26, the voltage variations on the signal lines $D_1$-$D_n$ will make the controlling signal 28 distort. Therein, the responding current (I) of the controlling signal 28 versus time (t) comprises both of direct current (DC) and alternative current (AC), as shown in FIG. 3. Unfortunately, the AC part of the responding current causes the respective input voltages being input into the driver IC chips 22*a*, 22*b* and 22*c* to be different. This causes the liquid crystal display panel 10 to display an image having band mura, and reduces a displaying quality of the liquid crystal display panel 10.

SUMMARY OF INVENTION

It is therefore a primary objective of the claimed invention to provide a driving circuit of a liquid crystal display (LCD) device to solve the above-mentioned problem.

According to the claimed invention,a driving circuit of a liquid crystal display device is provided. The driving circuit comprises a substrate, at least two driver integrated circuit (IC) chips positioned on the substrate, and an impedance device is electrically connected between the two driver IC chips for reducing a difference between respective input voltages being input into the two driver IC chips.

It is an advantage over the prior art that an impedance device including a capacitor and a resistor is utilized to connect the driver IC chips in the claimed invention. The impedance device can reduce the equivalent impedance (Z)

of the responding current of a controlling signal, so that the voltage drop on the impedance device can be reduced. Therefore, a difference between respective input voltages being input into the driver IC chips can be effectively decreased, and the driver IC chips can obtain approximately equal input voltages.

These and other objectives of the present invention will no doubt become obvious to those of ordinary skill in the art after reading the following detailed description of the preferred embodiment, which is illustrated in the multiple figures and drawings.

DETAILED DESCRIPTION

Figure 1:
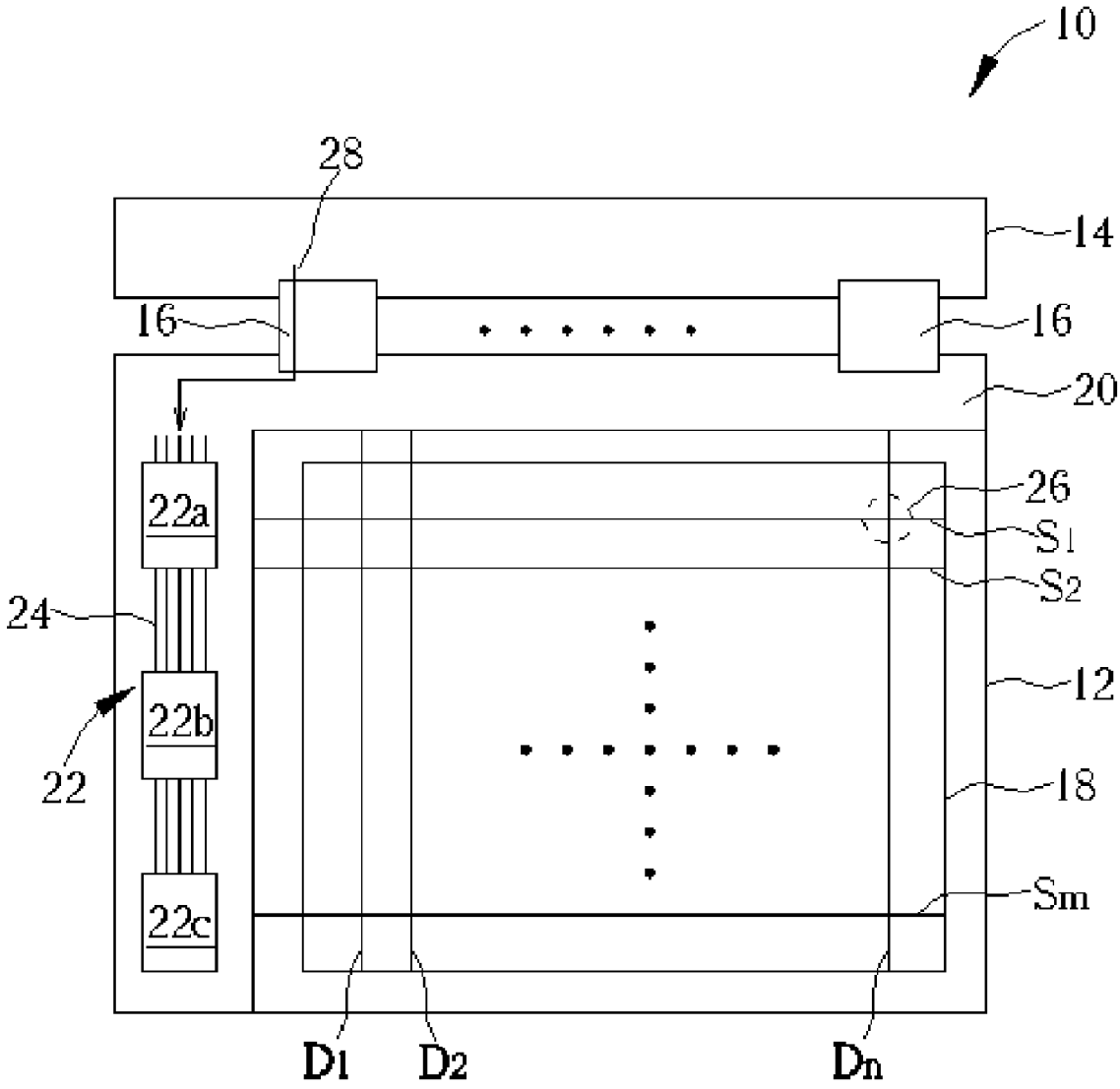
Fig. 1 Prior art
FIG. 1 is a schematic diagram of a liquid crystal display panel.
Figure 2:
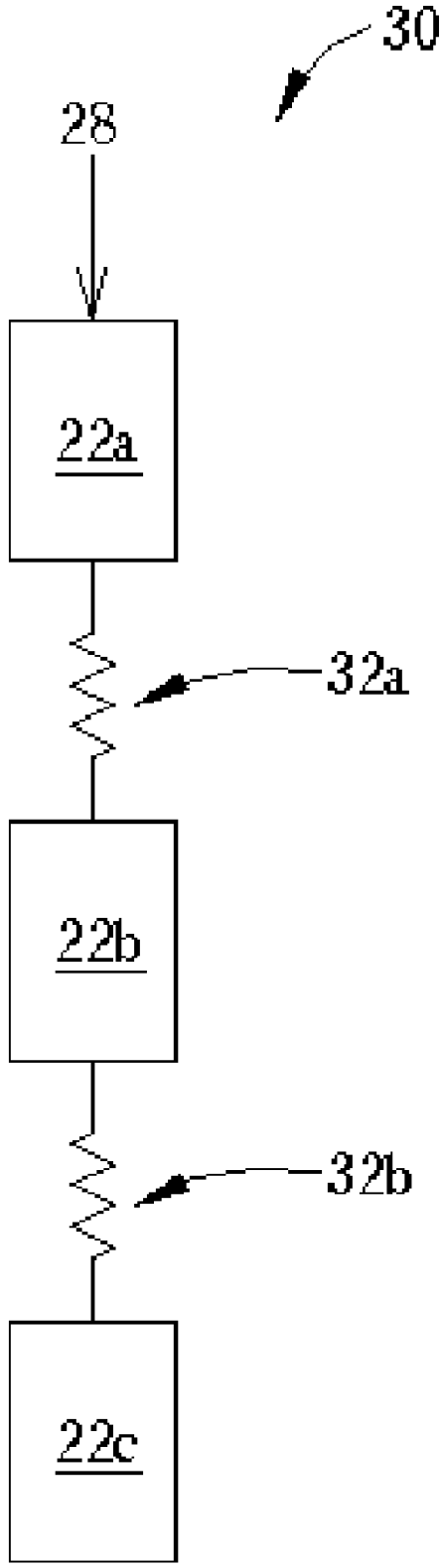
Fig. 2 Prior art
FIG. 2 is an equivalent circuit of the driving circuit shown in FIG. 1.
Figure 3:
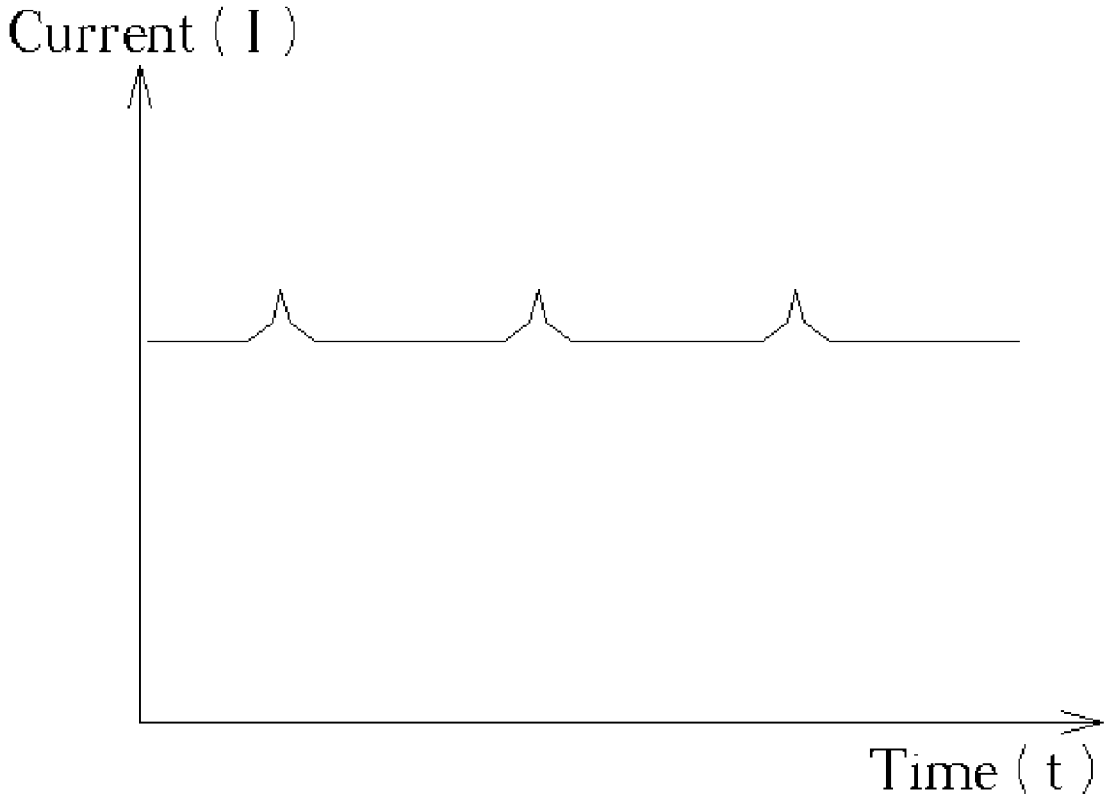
Fig. 3 Prior art
FIG. 3 is a relationship between the responding current of a controlling signal and the time.
Figure 4A:
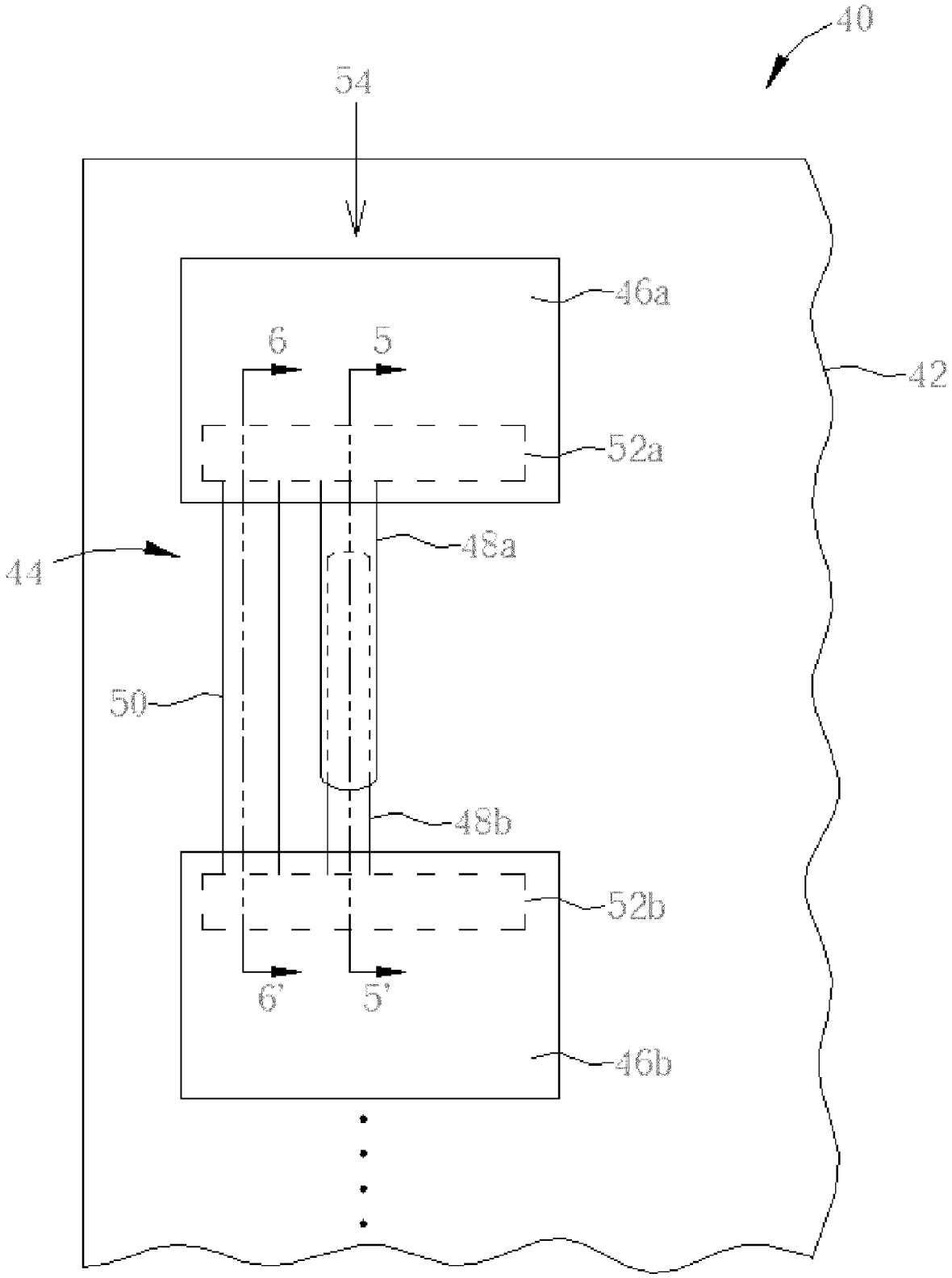
FIG. 4(A) is a schematic diagram of a driving circuit according to the present invention.

Please refer to FIG. 4(A). FIG. 4(A) is a schematic diagram of a driving circuit according to the present invention. As shown in FIG. 4(A), a liquid crystal display panel 40 comprises a substrate 42, and a driving circuit 44 positioned on the substrate 42. The driving circuit 44 at least comprises driver IC chips 46*a*, 46*b*, and metal wires 48*a*, 48*b*, 50. The driver IC chips 46*a* and 46*b* are directly formed on the substrate 42 by use of chip-on-glass (COG) technology, and are utilized for used for outputting switching or addressing signals to the scanning lines. The metal wires 48*a*, 48*b*, and 50 are utilized for connecting driver IC chips 46*a* and 46*b*. Additionally, the driving circuit 44 further comprises transparent conductive layers 52*a* and 52*b*. The transparent conductive layer 52*a* is positioned between the metal wires 48*a*, 50 and the driver IC chip 46*a*, while the transparent conductive layer 52*b* is connected between the metal wires 48*b*, 50 and the driver IC chip 46*b*. Furthermore, the electrical resistance of the transparent conductive layer 52*a* and 52*b* can be modified to make each of the driver IC chips 46*a* and 46*b* obtain an equal input voltage. The electrical resistance of the transparent conductive layer 52*a* or 52*b* is determined by properly modifying a dimension of the transparent conductive layer 52*a* or 52*b*.

Figure 4B:
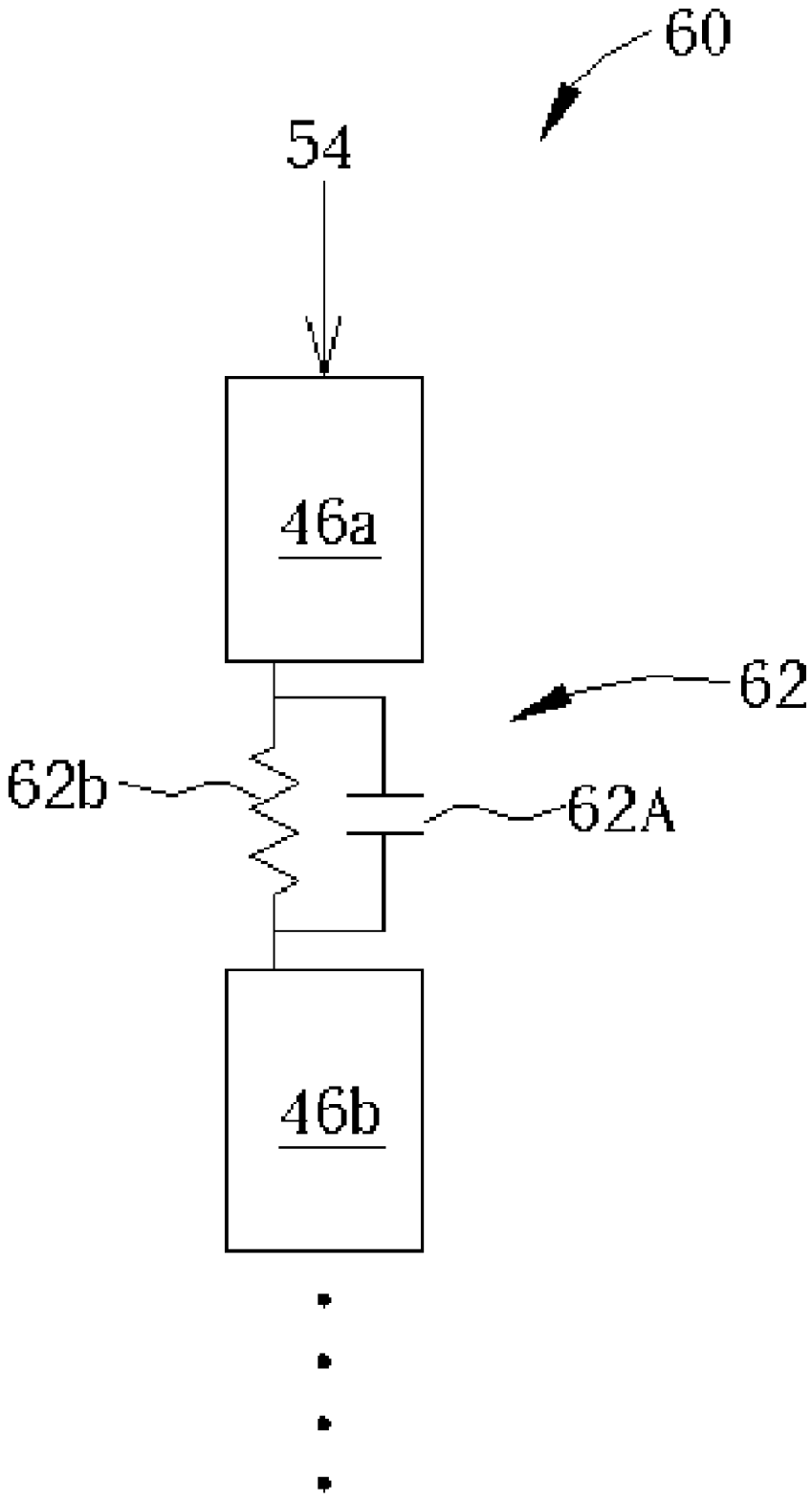
FIG. 4(B) is an equivalent circuit of the driving circuit shown in FIG. 4(A).

Please refer to FIG. 4(B). FIG. 4(B) is an equivalent circuit of the driving circuit shown in FIG. 4(A). As shown in FIG. 4(B), an equivalent circuit 60 comprises the driver IC chips 46*a*, 46*b*, and an impedance device 62 for connecting the driver IC chips 46*a* and 46*b*. The impedance device 62 comprises a capacitor 62*a* and a resistor 62*b*, which are electrically connected in parallel with each other. Moreover, the capacitor 62*a* is corresponding to the metal wires 48*a* and 48*b* shown in FIG. 4(A), while the resistor 62*b* is corresponding to the metal wire 50 shown in FIG. 4(A). In addition, the equivalent impedance (Z) of the impedance device 62 is represented by:

$$Z=R/(1+j\omega RC) \quad (1)$$

C is the capacitance of the capacitor 62*a*, R is the electrical resistance of the resistor 62*b*, j is an imaginary unit $$j=\sqrt{-1}$$

, and ωis an angular frequency. As represented in Eq.1, when the angular frequency(ω) gets larger and larger, the equivalent impedance (Z) becomes smaller. That is, as the angular frequency(ω) of the electrical current passing through the impedance device 62 gets larger and larger, the equivalent impedance (Z) of the impedance device 62 becomes smaller.

As described above, there are parasitic capacitors existing between the scanning lines $S_1$-$S_m$ and the signal lines $D_1$-$D_n$, so that the voltage variations on the signal lines $D_1$-$D_n$ will be coupled to the scanning lines $S_1$-$S_m$ through the parasitic capacitors at the overlapping regions 26, thus producing a glitch to disturb the controlling signal 28. Therefore, the responding current (I) of the controlling signal 28 versus time (t) comprises both of direct current (DC) and alternative current (AC), which leads to band mura. For reducing the influence of the above-mentioned disadvantages, the present invention utilizes the impedance device 62 including the capacitor 62*a* and resistor 62*b* to connect the driver IC chips 46*a* and 46*b*. The impedance device 62 is used to eliminate the influence of the AC part of the responding current of the controlling signal 28 (or 54). Specifically, when the responding current flows through the impedance device 62, the capacitor 62*a* can reduce the equivalent impedance (Z) resulting from the AC part of the responding current. As the angular frequency (ω) of the AC part of the responding current of the controlling signal 28 (or 54) gets larger, the equivalent impedance (Z) of the impedance device 62 will become smaller. As a result, the voltage drop on the impedance device 62 can be reduced, and further, a difference between respective input voltages being input into the driver IC chips 46*a* and 46*b* is also decreased. Accordingly, the present invention can prevent the voltage variation on the signal lines from reducing a displaying quality of the liquid crystal display panel 40.

Figure 5:
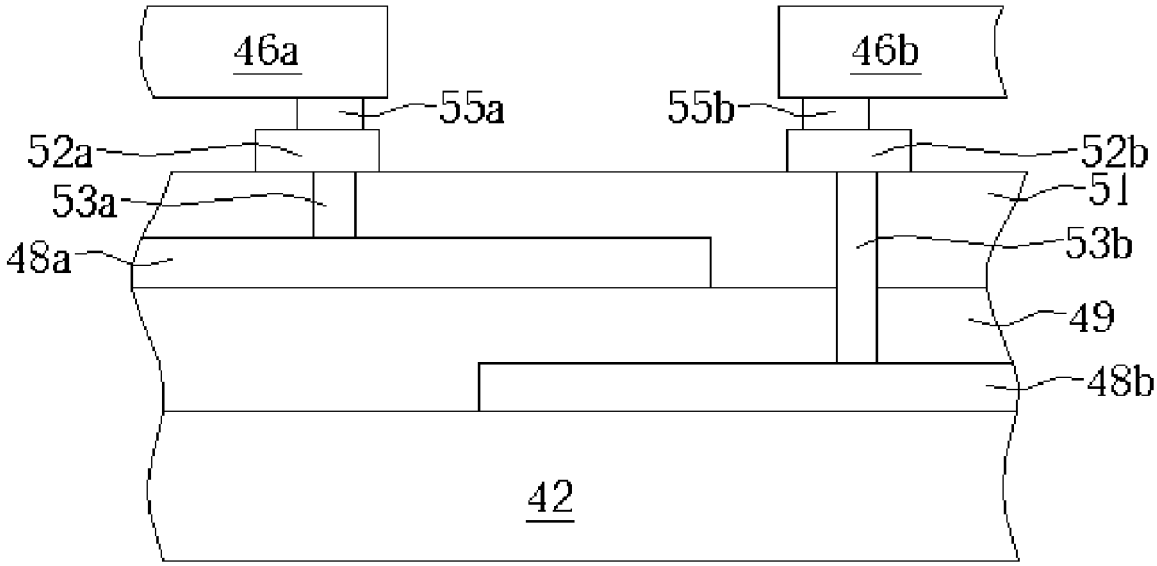
FIG. 5 is a cross-sectional view along line 5-5" of FIG. 4(A).
Figure 6A:
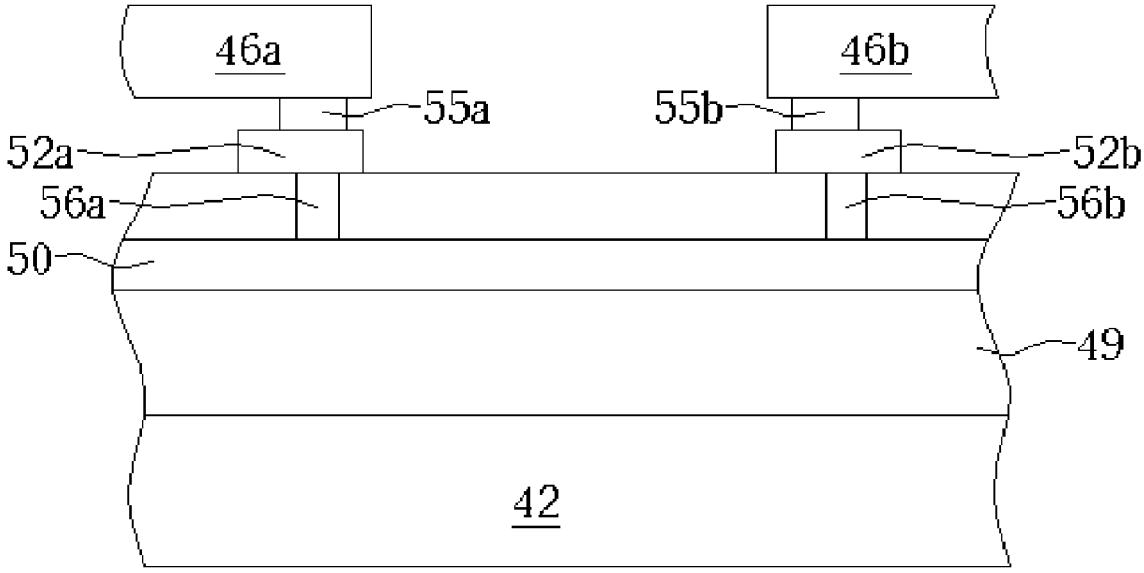
FIG. 6(A) and FIG. 6(B) are cross-sectional views along line 6-6" of FIG. 4(A).
Figure 6B:
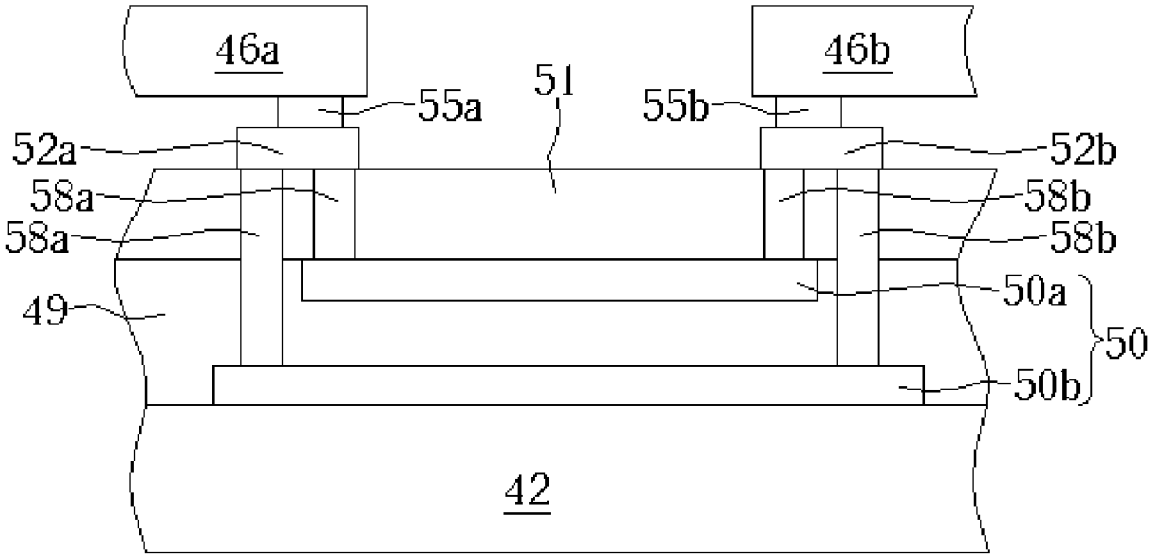

Please refer to FIG. 5 to FIG. 6(B). FIG. 5 to FIG. 6(B) are structural diagrams of the capacitor and the resistor according to the present invention. Furthermore, FIG. 5 is a cross-sectional view along line 5-5" of FIG. 4(A), while FIG. 6(A) and FIG. 6(B) are cross-sectional views along line 6-6" of FIG. 4(A). As shown in FIG. 5, the substrate 42 comprises the metal wires 48*a* and 48*b* thereon. An insulation layer 49 is located between the metal wires 48*a* and 48*b*, and a protective layer 51 is positioned on the metal wire 48*a*. The insulation layer 49 and the protective layer 51 are both composed of silicon nitride or silicon oxide. The metal wires 48*a*, 48*b* and the insulation layer 48 form a capacitor that is corresponding to the capacitor 62*a* shown in FIG. 4(B).

Additionally, the substrate 42 further comprises the driver IC chips 46*a*, 46*b*, and the transparent conductive layers 52*a*, 52*b* thereon. The transparent conductive layer 52*a* is located between the driver IC chip 46*a* and the metal wire 48*a*. Furthermore, the metal wire 48*a* is connected to the transparent conductive layer 52*a* through a contact plug 53*a*, and the driver IC chip 46*a* is connected to the transparent conductive layer 52*a* through a gold bump 55*a*. Similarly, the transparent conductive layer 52*b* is located between the driver IC chip 46*b* and the metal wire 48*b*. The metal wire 48*b* is connected to the transparent conductive layer 52*b* through a contact plug 53*b*, and the driver IC chip 46*b* is connected to the transparent conductive layer 52*b* through a gold bump 55*b*. The transparent conductive layers 52*a*, 52*b* are composed of indium tin oxide (ITO), the metal wire 48*b* and the scanning lines are simultaneously formed, and the metal wire 48*a* and the signal lines are concurrently formed.

As shown in FIG. 6(A), the insulation layer 49 is located on the substrate 42, the metal wire 50 is formed on the insulation layer 49, and the protective layer 51 is formed on the metal wire 50. The insulation layer 49 and the protective layer 51 are both composed of silicon nitride or silicon oxide. The metal wire 50 is corresponding to the resistor 62*b* shown in FIG. 4(B). Additionally, the substrate 42 further comprises the driver IC chips 46*a*, 46*b*, and the transparent conductive layers 52*a*, 52*b* thereon. The transparent conductive layer 52*a* is located between the driver IC chip 46*a* and the metal wire 50. Furthermore, the metal wire 50 is connected to the transparent conductive layer 52*a* through a contact plug 56*a*, and the driver IC chip 46*a* is connected to the transparent conductive layer 52*a* through a gold bump 55*a*. Similarly, the transparent conductive layer 52*b* is located between the driver IC chip 46*b* and the metal wire 50. The metal wire 50 is connected to the transparent conductive layer 52*b* through a contact plug 56*b*, and the driver IC chip 46*b* is connected to the transparent conductive layer 52*b* through a gold bump 55*b*. The transparent conductive layers 52*a*, 52*b* are composed of indium tin oxide (ITO), the metal wire 50 and the scanning lines can be formed simultaneously, or the metal wire 50 can be formed concurrently with the signal lines.

Please refer to FIG. 6(B). FIG. 6(B) is a structural diagram of the resistor according to another embodiment of the present invention. As shown in FIG. 6(B), the insulation layer 49 and the metal wire 50 are formed on the substrate 42, and the protective layer 51 is formed on the insulation layer 49 and the metal wire 50. The metal wire 50 includes metal wires 50*a* and 50*b*, and the insulation layer 49 is interposed between the metal wires 50*a* and 50*b*. The insulation layer 49 and the protective layer 51 are both composed of silicon nitride or silicon oxide. The metal wire 50 is corresponding to the resistor 62*b* shown in FIG. 4(B). Additionally, the substrate 42 further comprises the driver IC chips 46*a*, 46*b*, and the transparent conductive layers 52*a*, 52*b* thereon. The metal wires 50*a* and 50*b* are respectively connected to the transparent conductive layer 52*a* through contact plugs 58*a*, and the driver IC chip 46*a* is connected to the transparent conductive layer 52*a* through a gold bump 55*a*. Similarly, the metal wires 50*a* and 50*b* are respectively connected to the transparent conductive layer 52*b* through contact plugs 58*b*, and the driver IC chip 46*b* is connected to the transparent conductive layer 52*b* through a gold bump 55*b*. The transparent conductive layers 52*a*, 52*b* are composed of indium tin oxide (ITO), the metal wire 50*b* can be formed simultaneously with the scanning lines, and the metal wire 50*a* and the signal lines can be formed simultaneously.

The above-mentioned driving circuit is used to output switching or addressing signals to the scanning lines. Moreover, the driving circuit of the present invention can be used to output image signals to the signal lines, as is known to those skilled in the art.

Compared to the prior art, an impedance device including a capacitor and a resistor is utilized to connect the driver IC chips in the present invention. When the voltage variation on the signal lines causes the responding current of the controlling signal to generate alternative current and direct current, the impedance device can reduce the equivalent impedance (Z) of the responding current of the controlling signal. The voltage drop on the impedance device can be reduced, so that a difference between respective input voltages being input into the driver IC chips can be effectively decreased, and the driver IC chips can obtain approximately equal input voltages. As a result, the present invention can prevent the voltage variation on the signal lines from reducing a displaying quality of the liquid crystal display panel.

Those skilled in the art will readily observe that numerous modifications and alterations of the device may be made while retaining the teachings of the invention. Accordingly, the above disclosure should be construed as limited only by the metes and bound of the appended claims.

What is claimed is:

1. A driving circuit of a liquid crystal display device comprising:

a substrate, comprising a plurality of scanning lines and a plurality of signal lines thereon;

at least two driver integrated circuit (IC) chips positioned on the substrate; and an impedance device electrically connected between the two driver IC chips for reducing a difference between respective input voltages being input into the two driver IC chips, the impedance device comprising a resistor and a capacitor, the resistor and the capacitor being electrically connected in parallel with each other.

2. The driving circuit of claim 1 wherein the driver IC chips are used for outputting switching or addressing signals to the scanning lines.

3. The driving circuit of claim 1 wherein the driver IC chips are used for outputting image signals to the signal lines.

4. The driving circuit of claim 1 wherein the substrate comprises a first metal layer, a second metal layer, and an insulation layer interposed between the first metal layer and the second metal layer.

5. The driving circuit of claim 4 wherein the resistor comprises at least a first conductive wire.

6. The driving circuit of claim 5 wherein both of the first conductive wire and the scanning lines are parts of the first metal layer.

7. The driving circuit of claim 5 wherein both of the first conductive wire and the signal lines are parts of the second metal layer.

8. The driving circuit of claim 4 wherein the scanning lines are parts of the first metal layer, and the signal lines are parts of the second metal layer.

9. The driving circuit of claim 8 wherein the capacitor comprises a second conductive wire that is a part of the first metal layer, a third conductive wire that is a part of the second metal layer, and the insulation layer interposed between the second conductive wire and the third conductive wire.

10. The driving circuit of claim 1 wherein a transparent conductive layer is positioned between each of the driver IC chips and the impedance device, each of the driver IC chips being capable of receiving an approximately identical input voltage through each of the transparent conductive layers.

11. The driving circuit of claim 1 wherein the liquid crystal display device is designed by applying wiring on array (WOA) technology, and the liquid crystal display device is driven by the driving circuit.

12. A liquid crystal display device comprising:

a first substrate;

a second substrate opposite to and in parallel with the first substrate, the second substrate comprising a plurality of pixels arranged in a matrix; and a driving circuit positioned on the second substrate for outputting signals to the pixels, the driving circuit comprising:

at least two driver integrated circuit (IC) chips positioned on the second substrate; and an impedance device electrically connected between the two driver IC chips, the impedance device having a resistor and a capacitor being electrically connected in parallel with each other for reducing a difference between respective input voltages being input into the two driver IC chips.

13. The liquid crystal display device of claim 12 wherein the driving circuit is a scanning line driving circuit.

14. The liquid crystal display device of claim 12 wherein the driving circuit is a signal line driving circuit.

15. The liquid crystal display device of claim 12 wherein the resistor comprises at least a first conductive wire.

16. The liquid crystal display device of claim 12 wherein the capacitor comprises a second conductive wire, a third conductive wire, and an insulation layer interposed between the second conductive wire and the third conductive wire.

17. The liquid crystal display device of claim 12 wherein a transparent conductive layer is positioned between each of the driver IC chips and the impedance device, each of the driver IC chips being capable of receiving an approximately identical input voltage through each of the transparent conductive layers.

* * * * *